US007692080B1

(12) United States Patent
Rushing

(10) Patent No.: US 7,692,080 B1
(45) Date of Patent: Apr. 6, 2010

(54) FRET WIRE WITH BENDING NOTCHES

(75) Inventor: Donna W. Rushing, 1663 Piedmont Rd., New Market, TN (US) 37820

(73) Assignee: Donna W. Rushing, New Market, TN (US)

( * ) Notice: Subject to any disclaimer, the term of this patent is extended or adjusted under 35 U.S.C. 154(b) by 0 days.

(21) Appl. No.: 12/075,072

(22) Filed: Mar. 7, 2008

(51) Int. Cl.
*G10D 3/04* (2006.01)

(52) U.S. Cl. ..... 84/314 R

(58) Field of Classification Search ..... 84/314 R
See application file for complete search history.

(56) References Cited

U.S. PATENT DOCUMENTS

| | | | | | |
|---|---|---|---|---|---|
| 463,954 | A | * | 11/1891 | Middlebrooke | 84/314 R |
| 501,743 | A | * | 7/1893 | Stratton | 84/314 R |
| 1,472,943 | A | * | 11/1923 | Shaeffer | 84/314 R |
| 1,727,620 | A | * | 9/1929 | Smith | 84/314 R |
| 2,492,845 | A | * | 12/1949 | Conkling et al. | 84/314 R |
| 2,816,469 | A | * | 12/1957 | Gossom | 84/293 |
| 3,273,439 | A | * | 9/1966 | Keefe et al. | 84/314 R |
| 3,712,952 | A | * | 1/1973 | Terlinde | 84/314 R |
| 3,787,600 | A | * | 1/1974 | Muncy | 84/314 R |
| 3,791,252 | A | * | 2/1974 | Sibert et al. | 84/314 R |
| 4,064,779 | A | * | 12/1977 | Petillo | 84/314 R |
| 4,064,780 | A | * | 12/1977 | Bond | 84/314 R |
| 4,221,151 | A | * | 9/1980 | Barth | 84/314 R |
| 4,633,754 | A | * | 1/1987 | Chapman | 84/314 R |
| 4,723,469 | A | * | 2/1988 | Vogt | 84/314 R |
| 4,846,038 | A | * | 7/1989 | Turner | 84/293 |
| 4,981,064 | A | * | 1/1991 | Vogt | 84/314 R |
| 5,072,643 | A | * | 12/1991 | Murata | 84/293 |
| 5,952,593 | A | * | 9/1999 | Wilder | 84/314 R |
| 6,252,149 | B1 | * | 6/2001 | Matsushita | 84/314 R |
| 6,369,306 | B2 | * | 4/2002 | Chapman | 84/314 R |
| 6,613,969 | B1 | * | 9/2003 | Petillo et al. | 84/314 R |
| 7,060,881 | B2 | * | 6/2006 | Sakai | 84/314 R |
| 7,256,336 | B2 | * | 8/2007 | Muncy et al. | 84/314 R |
| 2001/0029827 | A1 | * | 10/2001 | Chapman | 84/314 R |
| 2009/0114076 | A1 | * | 5/2009 | Thidell | 84/314 R |

OTHER PUBLICATIONS

Downs, Terry, "Make Your Own Inexpensive Fret Bender," © 2007 Terry Downs Music™, viewed Mar. 3, 2009 at http://terrydownsmusic.com/technotes/fretbender/fret_bender.htm.*

* cited by examiner

*Primary Examiner*—Jeffrey Donels
*Assistant Examiner*—Robert W Horn

(57) ABSTRACT

The invention is a novel fret wire for use on the fingerboards of stringed instruments. The fret wire has a crown of any usable shape for contact with strings, as usual, but is distinguished by the structure of the tang affixed to the crown. The tang comprises bending notches that extend nearly through the height of the tang that allow the fret wire to more easily bend to shape of a contoured fret board. Tang elements formed by the notches embody random roughness or elongated striations to hold the fret wire securely in the grooves of a fret board.

4 Claims, 1 Drawing Sheet

DETAIL "A"

SECTION A-A

DETAIL "A"

FRET WIRE WITH BENDING NOTCHES

CROSS REFERENCE TO RELATED APPLICATIONS

This application is based on provisional application Ser. No. 60/443,551, filed on Jan. 30, 2003.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of musical stringed instruments and more specifically to an article of manufacture for use on the fingerboards of stringed instruments with which musicians make musical notes and chords.

Stringed instruments have been in existence for centuries. However, it wasn't until relatively recent centuries that frets were introduced in order to exact a more accurate means for deriving musical notes and chords. The first fret wire was patented in the 1800's. Since that time, few improvements have been introduced to this important component. The original fret was metal wire in the form of a "T". The wire has been marketed in long rolls, from which instrument makers cut lengths of the wire to appropriate lengths to fill the different length of slots on the various fingerboards of the instruments.

The leg, or tang, of the T extends to the bottom of the fingerboard slot and the top of the T extends above the fingerboard and is usually rounded to offer more comfort to the musician as he or she fingers the musical notes or chords.

Many fingerboards are curved or contoured. When the appropriate length of wire is cut for a particular slot, the wire is then pounded into the slot. Because of the shape of the wire, the top of the wire tends to stretch and the tang tends to bunch or gather. As a result, as the top of the wire pulls and the bottom of the wire pushes, there is a tendency for the lower ends of the wire to lift out of the slot, and may warp. In 1893, John F. Stratton received a patent on a fret design, U.S. Pat. No. 501,743. This fret design has substantially endured for subsequent years, to the present. This design embodied the T configuration, whereby the tang was inserted into a slot cut into the fingerboard of the instrument; and the top of the T constituted the actual fret with which musical notes and chords were made. Additionally, the tang was endowed with elongated triangular cutouts, designed to help hold the fret in place once installed. This design is adequate for instruments that have flat fingerboards; but are troublesome for contoured fingerboards.

High pressures or hammer blows required for installation frequently lead to distorted fret surfaces which must be leveled and dressed by skill laborers prior to sending the instrument to market, or releasing it to a repair customer. During routinely required replacement, fingerboard slots frequently become wide or otherwise damaged, exacerbating the problem of loosening frets.

BRIEF SUMMARY OF THE INVENTION

The primary object of the invention is to provide a new and improved fret wire.

Another object of the invention is to provide a less stiff fret wire.

Another object of the invention is to provide a fret wire that requires less force to install.

A further object of the invention is to provide a fret wire that does not retain internal stresses sufficient to cause it to loosen and rise from the fingerboard.

Yet another object of the invention is to provide a fret wire that may be installed and leveled by less skilled labor, speeding and reducing the cost of instrument manufacturing.

Still yet another object of the invention is to provide a fret wire that may be substituted into current instrument manufacturing processes without significant changes in those processes.

Another object of the invention is to provide a fret wire that may be manufactured with minimum adjustment to the current manufacturing processes and techniques.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an article of manufacture for use on the fingerboards of stringed instruments with which musicians make musical notes and chords comprising:

a fret wire of indeterminate length and width a fret wire with a leg, or tang, with a raised surface, affixed to the tang, that stands above the instrument fingerboard and constitutes the working portion of the fret wire a fret wire with bending notches that extend completely, or nearly completely, through the height of the tang, resulting in useful stand alone tang elements of indeterminate width and length

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 3:
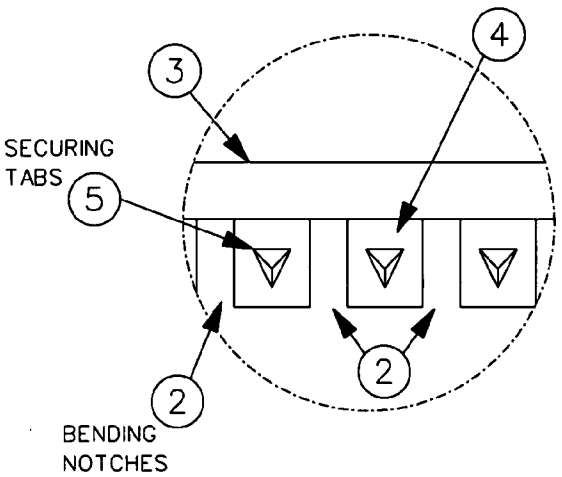
FIG. 3 is a detailed closeup of the invention
Figure 2:
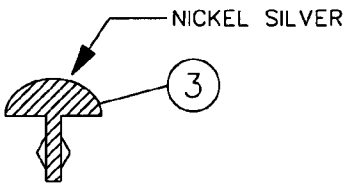
FIG. 2 is a cross section at the location indicated by A-A on FIG. 1
Figure 1:
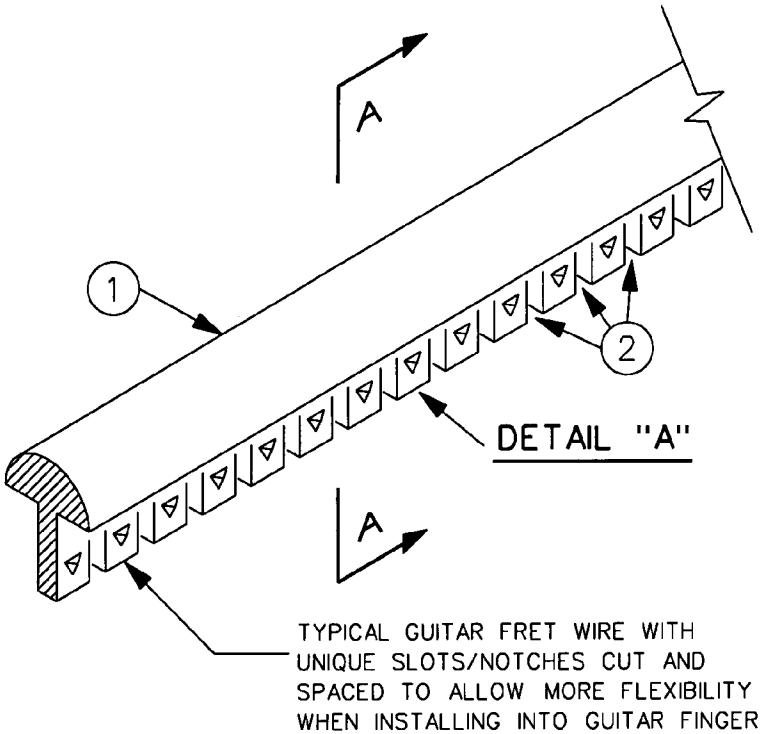
FIG. 1 is an oblique view of the invention.

With reference to FIGS. 1 through 3, the fret wire of this invention includes, but is not limited to, T-shaped fret wire 1 improved by a series of bending notches 2, thus allowing the upper cross bar of the fret wire 3 to be supported by a series of independent tangs 4 each hosting one or more securing tabs 5, rather than by a continuous tang as in current fret wire with a continuously uniform T-shaped cross section 1. The series of tangs 4 reduce the stiffness of the fret wire as compared to continuous-tang fret wire.

The fingerboard hosting the improved fret wire is the same in all respects as that used in current fretted stringed instruments. Installation of the improved fret wire is similar to that of current fret wire, with the exception that the improved fret wire need not be bent to shape prior to installation and the wire can be pressed or hammered into place more easily without the bending resistance encountered by the current fret wire design.

In a preferred embodiment of this invention, the fret wire is of the same cross section as current continuous-tang fret wire 1. The vertical elements of the fret wire consists of a series of separate tangs separated by bending notches 2 completely or nearly completely through the height of the tang. Each tang 4 hosts one or more securing taps 5 The tang 4 is of typical height of approximately, but not limited to a width of 1.5 mm. The bending notches 2 are spaced approximately but not limited to 3 mm apart and are approximately 0.5 mm wide, reaching to or close to the crossbar of the fret.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An article of manufacture for use on the fingerboards of stringed instruments with which musicians make musical notes and chords comprising: a fret wire having a length and a width, further comprising: a tang, with a raised surface, affixed to the tang, that stands above the instrument fingerboard and constitutes the working portion of the fret wire; bending notches that extend completely, or nearly completely, through the height of the tang, resulting in useful stand alone tang elements each element having an ordinary tang width and a length that is short with respect to the length of a fret on a musical instrument: whereon the tang elements embody abrasions along the sides, comprised of either random roughness or elongated striations of approximately 0.001 to 0.010 inch in height above the tang contour.

2. An apparatus as in claim 1 wherein the leg, or tang, is topped with a broad, rounded surface that, when installed in the slots of a fingerboard, comprise the useful, fretting portion of the device.

3. An apparatus as in claim 1 wherein the tang portion of the fret wire is notched so as to allow the fret wire to bend easily to follow the curve of contoured fingerboards.

4. An apparatus as in claim 1 wherein the tang elements contain roughened, or elongated, straight surfaces, that engage the fret slot to help hold the fret tightly in place once installed.

* * * * *